US005869216A

United States Patent [19]

Ong et al.

[11] Patent Number: 5,869,216

[45] Date of Patent: Feb. 9, 1999

[54] TONER PROCESSES

[75] Inventors: Beng S. Ong; Walter Mychajlowskij, both of Mississauga; Raj D. Patel, Ontario; Patricia A. Burns, Milton; Richard P. N. Veregin, Mississauga, all of Canada

[73] Assignee: Xerox Corporation, Stamford, Conn.

[21] Appl. No.: 6,742

[22] Filed: Jan. 13, 1998

[51] Int. Cl.[6] ..... G03G 9/097

[52] U.S. Cl. ..... 430/137

[58] Field of Search ..... 430/110, 137

[56] References Cited

U.S. PATENT DOCUMENTS

| | | | |
|---|---|---|---|
| 4,137,188 | 1/1979 | Uetake et al. | 430/111 |
| 4,533,614 | 8/1985 | Fukumoto et al. | 430/109 |
| 4,535,048 | 8/1985 | Inoue et al. | 430/110 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et asl. | 430/137 |
| 5,585,215 | 12/1996 | Ong et al. | 430/107 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowskij et al. | 430/137 |

*Primary Examiner*—Roland Martin
*Attorney, Agent, or Firm*—E. O. Palazzo

[57] ABSTRACT

A process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a salicylic acid, a catechol, or mixtures thereof at a temperature of from about 25° C. to about 80° C.; and optionally isolating the toner product, washing, and drying.

26 Claims, No Drawings

TONER PROCESSES

PENDING APPLICATION

Illustrated in copending application U.S. Ser. No. 903,694, the disclosure of which is totally incorporated herein by reference, is a process for the preparation of toner which process comprises, for example, (i) preparing, or providing an aqueous colorant dispersion, which dispersion is comprised of a colorant and an ionic surfactant in water;

(ii) blending said colorant dispersion with a latex emulsion comprised of resin particles, a nonionic surfactant, and an ionic surfactant of opposite charge polarity to that of the ionic surfactant in said colorant dispersion;

(iii) heating the resulting mixture below about the glass transition temperature (Tg) of the latex resin to form toner sized aggregates;

(iv) heating the resulting aggregate suspension of (iii) above about the Tg of the latex resin; and (v) retaining the temperature in the range of from about 30° C. to about 95° C., and subsequently, adding an aqueous solution of boric acid, or an aqueous solution of a metal salt; adjusting the pH of the resulting reaction mixture to from about 9 to about 12 by the addition of a base, followed by the addition of a salicylic acid or catechol; and optionally (vi) isolating, washing and drying the toner obtained.

In copending application U.S. Ser. No. 922,437, the disclosure of which is totally incorporated herein by reference, is, for example, a process for the preparation of toner comprising (i) aggregating with a metal complex, or metal ion a colorant dispersion with a latex emulsion and optional additives to form aggregates;

(ii) coalescing or fusing said aggregates; and optionally (iii) isolating, washing, and drying the toner.

The following copending applications, the disclosures of which are totally incorporated herein by reference, are being filed concurrently herewith.

U.S. Ser. No. 006,622 discloses a toner process wherein a colorant is flushed into a sulfonated polyester, followed by the addition of an organic soluble dye and an alkali halide solution.

U.S. Ser. No. 006,612 discloses a toner process with a first aggregation of sulfonated polyester, and thereafter, a second aggregation with a colorant dispersion and an alkali halide.

U.S. Ser. No. 006,640 discloses a toner process wherein a latex emulsion and a colorant dispersion are mixed in the presence of an organic complexing agent or compound, and wherein the latex can contain a sodio sulfonated polyester resin.

U.S. Ser. No. 006,521 discloses an emulsion/aggregation/fusing process for the preparation of a toner containing a resin derived from the polymerization of styrene butadiene, acrylonitrile, and acrylic acid.

U.S. Ser. No. 006,553 discloses a toner process wherein there is mixed an emulsion latex, a colorant dispersion, and a monocationic salt, and wherein the resulting mixture possesses an ionic strength of about 0.001 molar to about 5 molar.

U.S. Ser. No. 006,299 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

U.S. Ser. No. 006,508 discloses a toner process by blending an aqueous colorant dispersion with a latex blend containing a linear polymer and soft crosslinked polymer particles.

The appropriate components and processes of the copending applications may be selected for the processes of the present invention in embodiments thereof.

BACKGROUND OF THE INVENTION

The present invention is generally directed to toner processes, and more specifically, to chemical processes which involve the aggregation and fusion of latex, colorant like pigment, and additive particles into toner particles, and wherein the surface of the toner particles is chemically modified with certain in situ generated charge enhancing entities, or agents. These charging enhancing entities are believed to be chemically bonded to the surface of the toner particles. In embodiments, the present invention is directed to chemical processes for obtaining toners wherein the toner surface is chemically modified to provide suitable charging characteristics, and in embodiments toner compositions with a volume average diameter of from about 1 to about 20 microns, and preferably from about 2 to about 10 microns, in volume average diameter, with a narrow particle size distribution as conventionally characterized by GSD of, for example, less than 1.35, and preferably less than about 1.25, and more specifically, from about 1.12 to about 1.25 as measured on the Coulter Counter. The resulting toners can be selected for known electrophotographic imaging and printing processes, including digital color processes.

PRIOR ART

In xerographic systems, especially color systems, small sized toners of preferably from about 2 to about 7 microns are important to the achievement of high image quality for process color applications. It is also important to have a low image pile height to eliminate, or minimize image feel and avoid paper curling after fusing. Paper curling can be particularly pronounced in xerographic color processes primarily because of the presence of relatively high toner coverage as a result of the application of three to four color toners. During the fusing step, moisture is driven off from the paper due to high fusing temperatures of from about 120° C. to 200° C. In the situation wherein with only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

It is preferable to use small toner particle sizes, such as from about 2 to about 7 microns, and with high colorant, especially pigment loading, such as from about 4 to about 15 percent by weight of toner, thus the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present.

Furthermore, higher pigment loadings may also result in the sensitivity of charging behavior to charges in environmental conditions such as temperature and humidity. Toners prepared in accordance with the processes of the present invention minimize, or avoid these disadvantages.

Numerous processes are known for toner preparation, such as, for example, conventional processes wherein a resin is melt blended or extruded with a pigment, micronized and pulverized to provide toner particles. The average volume particle diameter which can be cost effectively produced by conventional processes are generally over 8 or 9 microns with a typical GSD of over 1.4. In these conventional processes, it is, therefore, important to subject the toners to a size classification to achieve a decreased GSD to a more acceptable level of, for example, about 1.35 to thereby provide reasonable image quality. In general, two or three classification cycles may be required, and the toner yields after classification can range from about 40 percent to about 90 percent depending on the toner size and GSD requirements. Generally, for toners with average particle size diameters of from about 11 microns to about 15 microns, toner yields range from about 70 percent to about 85 percent after classification. For smaller sized toners, such as about 7 or 8 micron toners, lower yields of about 50 to 80 percent can result after classification. With the processes of the present invention in embodiments, small toner sizes of, for example, from about 2 to about 7 microns, and GSD of less than about 1.35, and more specifically, less than about 1.25 can be obtained without classification processes. Since no or minimum classification is needed with the processes of the present invention, in embodiments small toners of from about 2 microns to about 7 microns can be economically prepared in yields of about 90 percent, or greater.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles are obtained. In U.S. Pat. No. 4,797,339, there is disclosed a process for the preparation of toners by resin emulsion polymerization, wherein similar to the '127 patent certain polar resins are selected; and U.S. Pat. No. 4,558,108, discloses a process for the preparation of a copolymer of styrene and butadiene by specific suspension polymerization. Other prior art that may be of interest includes U.S. Pat. Nos. 3,674,736; 4,137,188 and 5,066,560.

Emulsion/aggregation processes for the preparation of toners with optional charge control additives are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners).

SUMMARY OF THE INVENTION

Examples of features of the present invention in embodiments thereof include:

It is a feature of the present invention to provide toner compositions and processes with many of the advantages illustrated herein.

In another feature of the present invention there are provided simple and economical processes for the preparation of black and colored toner compositions with a toner size of, for example, from about 1 to about 20 microns in volume average diameter and narrow GSD of less than 1.35, and wherein the toners display controlled charging characteristics.

In another feature of the present invention there are provided simple processes for black and colored toner compositions, which processes involve first aggregating and coalescing latex and colorant, such as pigment particles into toner particles, followed by optional washing, and thereafter modifying with an in situ generated charge enhancing entity, thereby providing effective control over the charging characteristics of the resultant toners.

In a further feature of the present invention there is provided a process for the preparation of toner compositions with an average particle volume diameter of from between about 1 to about 15 microns, and preferably from about 2 to about 7 microns, and a narrow GSD of less than about 1.35, and preferably less than about 1.25 as measured by a Coulter Counter, and which toners display the required charging characteristics for proper image development.

A further feature of the present invention is the provision of toner processes whereby toner compositions with desirable charging properties are obtainable by the aggregation and the coalescence of latex and colored, especially pigment particles in the presence of suitable ionic and nonionic surfactants (aggregation/coalescence process), and wherein the surface of the toners is chemically modified by the reaction of a metal ion with an ortho-hydroxybenzoic acid (salicylic acid) and/or orthodihydroxybenzene (catechol).

In a further feature of the present invention there is provided an aggregation/coalescence process for the preparation of toner compositions with certain effective particle sizes achieved by properly controlling the temperature of the aggregation, and which processes comprise heating a mixture of latex and pigment particles in the presence of suitable surfactants at a temperature below the glass transition temperature (Tg) of the latex resin to form toner sized aggregates, followed by heating above the resin Tg to form mechanically stable toner particles, and subsequent treatment with a metal ion and a salicylic acid and/or catechol at a pH above 7, and preferably between about 8 and about 10.

In a further feature of the present invention there is provided an aggregation/coalescence process for the preparation of toners with narrow particle size distribution as characterized by a GSD less than 1.35, and preferably less than 1.25 as measured by the Coulter Counter.

In still a further feature of the present invention there is provided an aggregation/coalescence process for toner compositions of small particle size of from about 2 to about 7 microns in volume average diameter and GSD of less than about 1.25 in overall process yields of from about 85 percent to over 95 percent without conventional size classification.

In yet another feature of the present invention there are provided toner compositions with high charge levels of, for example, over 25 $\mu$C/gram negative charge polarity against a suitable carrier.

Moreover, in another feature of the present invention there are provided toner compositions with excellent color mixing properties and high image projection efficiencies of in excess of about 70 percent as measured by the Match Scan II spectrophotometer available from Milton-Roy.

A further feature of the present invention is the provision of small toner compositions which when fused on paper substrates do not lead to feature ionable paper curl and image feel.

In another feature of the present invention there are provided processes for the preparation of toner comprised of resin and pigment, and wherein the toner surface contains chemically attached charge controlling entities, and which toner can be of a preselected size, such as from about 1 to about 10 microns in volume average diameter, and with narrow GSD of less than about 1.35, and more specifically, less than about 1.25.

In embodiments of the present invention, there are provided toner compositions comprised of binder, such as a binder resin, and colored, especially pigment particles, and wherein the toner particle surface has chemically attached thereto a charge control entity derived from the reaction of a metal salt with the toner particle surface, followed by subsequent reaction with a salicylate ion, a catechol ion, or mixtures thereof. In embodiments, the process of the present invention is comprised of aggregating a latex and colorant particles in the presence of suitable surfactants to form toner sized aggregates at a temperature below about the Tg of the latex resin, followed by coalescence of the components of the aggregates at a temperature about above the Tg of the resin to form mechanically robust toner particles, and wherein the aggregate size, and thus the toner size, is primarily controlled by the temperature at which the aggregation is conducted. During the coalescence, a stabilization agent which prevents the aggregates from growing in size with temperature is optionally, but preferably, added before the temperature is increased above the Tg of the latex resin. After coalescence, the toner is preferably washed, and then treated, or reacted with a metal salt and a salicylate ion and/or a catechol ion in water at a suitable pH of, for example, from about 8 to about 12 and a temperature of, for example, from about 20° C. to about 70° C, and preferably at from about 40° C. to about 60° C. (Centigrade), for an effective duration of, for example, from about 15 minutes to about several hours, such as about 10 hours, before the toner is filtered, washed with water, and then dried in an oven, a freeze dryer, spray dryer, or fluid bed.

In embodiments, the present invention is directed to aggregation/coalescence toner processes, which comprises (i) blending an aqueous colorant, such as a pigment dispersion containing a cationic surfactant such as benzalkonium chloride with a latex emulsion containing an anionic surfactant such as sodium dodecylbenzene sulfonate with a homogenizer, thereby causing flocculation of latex and colorant like pigment particles primarily as a result of the destabilization caused by neutralization of oppositely charged surfactants; (ii) heating the flocculent mixture at a temperature of about 30° C. to about 60° C., thereby inducing formation of toner sized aggregates, and which aggregates are comprised of latex particles, colorant particles, such as pigment particles, and surfactants, and wherein the aggregate size is, for example, from about 2 microns to about 10 microns in volume average diameter with a GSD of less than about 1.35, and more specifically, from about 1.14 to about 1.25; (iii) effecting by heating coalescence of the components of the aggregates to form mechanically stable integral toner particles, which heating is accomplished in the presence of additional anionic surfactant, at a temperature of from about 65° C. to about 100° C. for a duration of, for example, about 30 minutes to about 10 hours; (iv) washing the resulting toner with water or an aqueous base solution, followed by reacting the toner in an aqueous medium with a metal salt, such as zinc sulfate, and a salicylic acid, a catechol or mixtures thereof, at a pH of from about 8 to about 12 and a temperature of from about 25° C. to about 80° C., isolating the toner by known methods, such as filtration, washing primarily to remove surfactants, and drying.

The chemical treatment of the toner particles after coalescence (iv) is believed to result in the chemical attachment of the metal ions from the metal salt onto the toner surface. The surface-bound metal ions in turn react with the added salicylate or catecholate ions, resulting in the formation of surface-bound charge controlling functionalities on the toner particles.

Embodiments of the present invention relate to a process for the preparation of toner comprising blending an aqueous colorant dispersion and a latex emulsion containing resin; heating the resulting mixture at a temperature below about the glass transition temperature (Tg) of the latex resin to form toner sized aggregates; heating the resulting aggregates at a temperature above about the Tg of the latex resin to effect fusion or coalescence of the components of aggregates; filtering the toner resulting and redispersing the toner in water at a pH of above about 7; contacting the resulting mixture with a metal halide or salt, and then with a mixture of an alkaline base and a salicylic acid, a catechol, or mixtures thereof at a temperature of from about 25° C. to about 80° C.; and optionally isolating the toner product by filtration, washing, and drying; a process wherein the blending of the aqueous colorant dispersion with the latex emulsion containing resin is from about 20° C. to about 30° C.; the pH is from about 8 to about 11; and isolating the toner, followed by filtration, washing and drying, and wherein the filtering removes soluble surfactants; a process for the preparation of toner of resin and colorant comprising (i) preparing, or providing an aqueous colorant dispersion, which dispersion is comprised of a colorant and an ionic surfactant;

(ii) blending the colorant dispersion with a latex emulsion comprised of resin particles, a nonionic surfactant, and an ionic surfactant of opposite charge polarity to that of the ionic surfactant in the colorant dispersion;

(iii) heating the resulting mixture below about the glass transition temperature (Tg) of the latex resin particles to form toner sized aggregates;

(iv) heating the resulting aggregate suspension of (iii) above about the Tg of the latex resin particles in the presence of an aggregate stabilizer;

(v) filtering and optional washing the toner product, and thereafter redispersing the toner in water at a pH of above or equal to about 7;

(vi) adding to the resulting mixture a metal halide or salt, and then a mixture of an alkaline base and a salicylic acid together with a catechol at a temperature ranging from about 25° C. to about 80° C.; and (vii) coating, if appropriate, followed by isolating the toner product, optionally washing, and optionally drying; a process wherein the toner is prepared by blending the colorant dispersion with a latex emulsion by a high shearing device, and wherein the colorant dispersion is a pigment dispersion and contains an ionic surfactant, the latex contains a nonionic surfactant and an ionic surfactant of opposite charge polarity to that of ionic surfactant in the pigment dispersion; heating the resulting mixture at a temperature of about 30° C. to about 60° C. to effect formation of aggregates having a particle size of from about 2 to about 10 microns in volume average diameter; heating the aggregate suspension in the presence of an aggregate stabilizer to prevent, or minimize the aggregates from growing in size, and which heating is at a temperature of from about 65° C. to about 100° C.; filtering the toner and redispersing it in water at a pH above, or equal to about 7, and adding a metal halide or salt, and then an aqueous mixture of an alkaline base, and a salicylic acid, a catechol, or mixtures thereof, and which adding is at a temperature ranging from about 25° C. to about 80° C.; and isolating the toner product by filtration, washing, and drying; a process wherein the product toner size is from about 2 to about 10 microns in volume average diameter, and the toner possesses a particle size distribution of from about 1.12 to about 1.35; a process wherein the surfactant in the colorant dispersion is a cationic surfactant, and the ionic surfactant present in the latex emulsion is an anionic surfactant, or wherein the surfactant in the colorant dispersion is an anionic surfactant, and the ionic surfactant present in the latex emulsion is a cationic surfactant; a process wherein the ionic surfactant in the colorant dispersion is a cationic surfactant, and the ionic surfactant present in the latex emulsion is an anionic surfactant; a process wherein the heating of the latex, colorant, and surfactants in the aggregation (iii) is accomplished at temperatures of from about 15° C. to about 1° C. below the Tg of the latex resin for a duration of from about 0.5 hour to about 5 hours; the heating of the aggregate suspension in the coalescence (iv) is conducted at about 20° C. to about 50° C. above the Tg of the latex resin for a duration of about 1 hour to about 5 hours; and the adding of the metal salts and salicylic acid and/or catechol is accomplished at from about 40° C. to about 6020 C. for a duration of from about 0.5 hour to about 3 hours; a process wherein the metal halide or salt is selected from a group consisting of zinc acetate, zinc halide, zinc hydroxide, zinc nitrate, zinc sulfate, zinc toluene sulfonate, zinc trifluoroacetate, cadmium acetate, cadmium halide, cadmium carbonate, and cadmium sulfate; a process wherein the latex resin is prepared by emulsion polymerization of vinyl monomers selected from the group consisting of styrene and substituted styrenes, 1,3-dienes, substituted 1,3-dienes, acrylates, methacrylates, acrylonitrile, acrylic acid, and methacrylic acid; a process wherein the latex resin is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylateisoprene), poly(propyl acrylate-isoprene), poly(butyl acrylate-isoprene), poly(styrene-propyl acrylate), poly(styrene-butyl acrylate), poly (styrenebutadiene-acrylic acid), poly(styrene-butadiene-methacrylic acid), poly(styrene-butadiene-acrylonitrile-acrylic acid), poly(styrene-butyl acrylateacrylic acid), poly (styrene-butyl acrylate-methacrylic acid), poly(styrene-butyl acrylate-acrylonitrile), and poly(styrene-butyl acrylate-acrylonitrile-acrylic acid); and wherein the resin is optionally present in an amount ranging from 80 percent by weight to about 98 percent by weight of toner; a process wherein the resin is selected from the group consisting of poly(styrenebutadiene-acrylic acid) poly(styrene-butadiene-methacrylic acid), poly(styrene-butyl methacrylate-acrylic acid), poly(styrene-butyl acrylateacrylic acid), poly(styrene-butyl acrylate-acrylonitrile), poly(styrene-butyl acrylate-acrylonitrile-acrylic acid), and poly(styrene-butadiene-acrylonitrileacrylic acid); a process wherein the latex resin size is from about 0.05 to about 1 micron in average volume diameter, and the colorant particle size is from about 0.01 to about 1 micron in volume average diameter; a process wherein the latex resin is prepared by emulsion polymerization of vinyl monomers selected from the group consisting of styrene and substituted styrenes, 1,3-dienes, substituted 1,3-dienes, acrylates, methacrylates, acrylonitrile, acrylic acid, and methacrylic acid; a process wherein the nonionic surfactant present in the latex emulsion is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate and sodium dodecylnaphthalene sulfate; and wherein the cationic surfactant is optionally a quaternary ammonium salt; a process wherein the anionic surfactant is selected from the group consisting of sodium dodecyl sulfate, sodium dodecylbenzene sulfate and sodium dodecyinaphthalene sulfate; and wherein the cationic surfactant is a quaternary ammonium salt; a process wherein the nonionic, anionic and cationic surfactants are each present in an effective amount of from about 0.01 to about 5 weight percent of the total reaction mixture; a process wherein the colorant is a pigment of carbon black, magnetite, cyan, yellow, magenta pigments, or mixtures thereof; a process wherein the salicylic acid, catechol, metal halide or salt are each utilized in an amount of 0.01 to 5 percent by weight of toner solids; a process wherein there is added to the surface of the formed toner metal salts, metal salts of fatty acids, silicas, metal oxides, or mixtures thereof each in an amount of from about 0.1 to about 10 weight percent; a process wherein the salicylic acid and/or catechol, and metal halide or salt are each selected in an effective amount of 0.01 to 5 percent by weight of toner; a process wherein the salicylic acid and/or catechol, and metal halide or salt are each selected in an effective amount of 0.01 to 5 percent by weight of toner; a toner surface containing a charge enhancing entity derived from the reaction of a salicylic acid, or a catechol with a metal salt; and a process comprising blending a colorant dispersion with a latex emulsion containing resin and heating the mixture at a temperature below about, or equal to about the glass transition temperature (Tg) of the latex resin; heating at a temperature above about, or about equal to the Tg of the latex resin; isolating the toner mixture, and redispersing the mixture in water at a pH of equal to or above about 7, and preferably above 7; contacting the resulting mixture with a metal salt, and then contacting the mixture with a mixture of an alkaline base and a salicylic acid, a catechol, or mixtures thereof.

Examples of salicylic acids that can be selected for the reaction include suitable benzoic acids, such as 2-hydroxybenzoic acid, alkyl like methylsalicylic acids, halo, such as bromosalicylic acids, chlorosalicylic acids, iodosalicylic acids, 2-hydroxy-iso-phthalic acid, and the like; 3,5-dimethylsalicylic acid, 3,5-diethylsalicylic acid, 3,5-dipropylsalicylic acid, 3,5-dibromosalicylic acid, 3,5-chlorosalicylic acid, 3,5-iodosalicylic acid, 3,5-ditert-butylsalicylic acid and the like. Examples of catechols include dihydroxybenzene, methylcatechols, ethylcatechols, propylcatechols, 4-tertbutylcatechol and the like, and generally substituted benzenes, alkylcatechols, and the like. Examples of metal salts include zinc chloride, zinc bromide, zinc iodide, zinc nitrate, zinc sulfate, cadmium bromide, cadmium chloride, cadmium iodide, cadmium sulfate, other metal salts, and the like. In general, equimolar quantities of the metal salt and the salicylic acid or catechol are utilized in the reaction, with the effective amounts of combined metal ion and salicylic acid or catechol being in the range of, for example, from about 0.01 to about 5 percent by weight of toner, and preferably between about 0.05 to about 1 percent by weight of toner.

Illustrative examples of latex resins or polymers selected for the process of the present invention include known polymers such as poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylatebutadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylateisoprene), poly(propyl acrylate-isoprene), and poly (butyl acrylate-isoprene); poly(styrene-propyl acrylate), poly(styrene-butyl acrylate), poly(styrenebutadiene-acrylic acid), poly(styrene-butadiene-methacrylic acid), poly (styrene-butyl acrylate-acrylic acid), poly(styrene-butyl acrylatemethacrylic acid), poly(styrene-butyl acrylate-acrylonitrile), poly(styrenebutyl acrylate-acrylonitrile-acrylic acid), and the like. The resin selected in embodiments is present in various effective amounts, such as for example, from about 85 weight percent to about 98 weight percent of toner, and the latex particle size can be, for example, from about 0.05 micron to about 1 micron in volume average diameter as measured by the Brookhaven nanosize particle analyzer. Other sizes and effective amounts of latex particles may be selected in embodiments. The total of all toner components, such as resin, colorant, and optional toner additives is equal to about 100 percent, or 100 parts.

The resin selected for the process of the present invention is preferably prepared by emulsion polymerization methods, and the monomers utilized in such processes include styrene, acrylates, methacrylates, butadiene, isoprene, acrylonitrile, acrylic acid, methacrylic acid, styrene acrylates, styrene methacrylates, and the like. Known chain transfer agents, for example dodecanethiol, in effective amounts of, for example, from about 0.1 to about 10 percent, and/or carbon tetrabromide in effective amounts of from about 0.1 to about 10 percent, can also be employed to control the resin molecular weight during the polymerization. Other processes of obtaining resin particles of from, for example, about 0.05 micron to about 1 micron can be selected from polymer microsuspension process, such as the processes disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants, such as dyes, pigments, mixtures of dyes, mixtures of pigments, mixtures of pigments and dyes, other known suitable colorants, and especially pigments present in the toner in an effective amount of, for example, from about 1 to about 15 percent by weight of the toner, and preferably in an amount of from about 3 to about 10 weight percent, that can be selected include carbon black like REGAL 330®; magnetites, such as Mobay magnetites M08029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue pigment or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from. Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, and yellow pigments, and mixtures thereof. Examples of magentas that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a mono azo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

Colorant includes pigments, dyes, mixtures thereof, mixtures of pigments, mixtures of dyes, and the like.

Surfactants in amounts of, for example, from about 0.01 to about 20, or more specifically, from about 0.1 to about 15 weight percent of the reaction mixture in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of the reaction mixture.

Examples of ionic surfactants include anionic and cationic with examples of anionic surfactants being, for example, sodium dodecyl sulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of the reaction mixture.

Examples of cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 percent to about 5 percent by weight of the reaction mixture. Preferably, the molar ratio of the cationic surfactant used for flocculation to the anionic surfactant used in the latex preparation is in the range of from about 0.5 to about 4, and preferably from about 0.5 to about 2.

Examples of the additional surfactant, which may be added to the aggregate suspension during or prior to coalescence to, for example, prevent the aggregates from growing in size, or for stabilizing the aggregate size with increasing temperature can be selected from anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. These surfactants can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant generally employed as an aggregate size stabilization agent is, for example, from about 0.01 to about 10 percent by weight, and preferably from about 0.1 to about 5 percent by weight of the reaction mixture.

Surface additives that can be added to the toner compositions to primarily improve their powder flow properties include, for example, metal salts, metal salts of fatty acids, colloidal silicas, metal oxides, such as titanium oxides, tin oxides, other known flow additives, mixtures thereof and the like, which additives are usually present in an amount of, for example, from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa, each in amounts of from 0.1 to 2 percent, and which additives can be, for example, added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various pieces of the present invention. These Examples are intended to be illustrative only and are not intended to limit the scope of the present invention.

EXAMPLE I

A surfactant solution of 135.4 grams of NEOGEN R™ anionic surfactant and 64.7 grams of ANTAROX CA-897™ nonionic surfactant in 8,030 grams of deionized water was charged into a 5 gallon reactor with the aid of a funnel. To the surfactant solution was added a solution of 60.2 grams of ammonium persulfate initiator in 1 kilograms of deionized water. The reactor jacket was set to maintain a temperature of 25° C. Separately, a mixture of 60.2 grams of carbon tetrabromide, 120.4 grams of acrylic acid, and 120.4 grams of dodecanethiol was added to the monomer mixture of 4,936 grams of styrene and 1,048 grams of n-butyl acrylate. The mixture was then charged into the 5 gallon reactor maintained under a nitrogen atmosphere by a continuous stream of nitrogen purging through the reactor system. The reactor agitator was started and the nitrogen purge maintained until the reactor reached 70° C. (Centigrade throughout) at which time the reactor was completely sealed. The reactor temperature was programmed to the following heating profile: 25° C. for 30 minutes, raising the temperature from 25° C. to 45° C. at a rate of 1° C. per minute, from 45° C. to 53° C. at a rate of 0.5° C. per minute, from 53° C. to 55° C. at a rate of 0.3° C. per minute, and from 55° C. to 70° C. at a rate of 0.1C per minute. Subsequently, the mixture was retained at 70° C. for 4 hours before cooling down to room temperature, about 25 degrees, and discharged into plastic buckets. The latex product obtained was subjected to centrifugation at 3,000 rpm for 2 minutes to, for example, remove low molecular weight materials. The resulting latex exhibited the following properties: $M_w$=30.5 K (30,500), $M_n$=4.9 K, particle size=260 nanometers, and Tg=54.9° C.

260.0 Grams of the above latex and 220.0 grams of an aqueous cyan pigment dispersion containing 4.0 grams of Cyan Pigment 15.3 and 2.6 grams of cationic surfactant SANIZOL B™ were added to 400 milliliters of water with high shear stirring using a polytron. The resulting mixture was transferred to a 2 liter reaction vessel and heated at a temperature of 50° C. for 1.0 hour before 35 milliliters of a 16 percent aqueous NEOGEN R™ solution were added. Subsequently, the mixture was heated to 95° C. and held there for a period of 3.5 hours before cooling down to room temperature, and filtered. The filter cake was redispersed in 4 liters of water with the aid of a mechanical stirrer, and the resulting toner slurry was brought to a pH of 8.5 with dilute aqueous KOH solution, stirred for 30 minutes, and filtered. The filter cake was again redispersed in 4 liters of water, stirred for 30 minutes, and filtered. The washing was repeated twice in the same manner.

85 Grams of the filter cake, which contained about 50 grams of dry toner particles, were dispersed in 500 milliliters of water. After the pH of the mixture was adjusted to 8.5 with dilute aqueous KOH solution, 0.38 gram of zinc sulfate heptahydrate was added. The resulting mixture was heated to 50° C. with stirring before a solution of 0.67 gram of 3,5-di-tert-butylsalicylic acid and 0.2 gram of 85 percent potassium hydroxide in 20 milliliters of water was added. The reaction mixture was then stirred at 50° C. for two hours and filtered. The resulting toner, which was comprised of the above resin, pigment, and on the toner surface a charge enhancing entity derived from the reaction of zinc sulfate and 3,5-di-tert-butylsalicylic acid, evidenced a particle size of 6.8 microns in volume average diameter and a particle size distribution of 1.21 as measured with a Coulter Counter.

The toner charging evaluation was performed according to the following procedure. In a 120 milliliter glass bottle, 1 gram of the prepared toner was added to 24 grams of carrier particles comprised of 65 micron steel core particles coated with a mixture of 20 percent by weight of VULCAN carbon black dispersed in 80 percent of poly(methyl methacrylate), and wherein the carrier coating weight was 1 percent. Samples, about 5 to 10 grams of the toner and carrier, were retained in an environmental chamber at either 20 or 80 percent relative humidity for about 18 hours. The bottle was then sealed, and the contents were mixed by roll milling for 30 minutes to obtain a stable triboelectric charge. The toner charge was measured using the standard Faraday Cage tribo blow-off apparatus. For the toner of this Example, the tribo values at 20 and 80 percent relative humidity were, respectively, 63.6 and −18.4 microcoulombs per gram ($\mu$C/g).

EXAMPLE II

A cyan toner was prepared in accordance with the procedure of Example I except that the toner was treated with 0.13 gram of zinc sulfate heptahydrate and 0.22 gram of 3,5-di-tert-butylsalicylic acid and 0.15 gram of 85 percent potassium hydroxide. The toner, which was comprised of resin, pigment, and on its surface a charge enhancing entity derived from zinc sulfate and 3,5-di-tert-butylsalicylic acid, evidenced a particle size of 7.2 microns in volume average diameter and a particle size distribution of 1.18 as measured on a Coulter Counter. The tribo values of the toner as evaluated, according to the procedure of Example I, were −60.8 $\mu$C/g and −19.8 $\mu$C/g at, respectively, 20 and 80 percent relative humidity.

EXAMPLE III

A cyan toner was prepared in accordance with the procedure of Example I except that the toner was treated with 0.065 gram of zinc sulfate heptahydrate and 0.11 gram of 3,5-di-tert-butylsalicylic acid and 0.1 gram of 85 percent potassium hydroxide. The toner, which was comprised of resin, pigment, and on its surface a charge enhancing entity derived from zinc sulfate and 3,5-di-tert-butylsalicylic acid, evidenced a particle size of 6.9 microns in volume average diameter and a particle size distribution of 1.18 as measured on a Coulter Counter. The tribo values of the toner as evaluated according to the procedure of Example I were −56.3 $\mu$C/g and −15.6 $\mu$C/g at, respectively, 20 and 80 percent relative humidity.

COMPARATIVE EXAMPLE A

A comparative toner was prepared in accordance with the procedure of Example I except that the toner was not subjected to the reaction with zinc sulfate and 3,5-di-tert-butylsalicylic acid. The toner evidenced a particle size of 7.0 microns in volume average diameter and a particle size distribution of 1.21. Evaluation of the toner in accordance with the procedure of Example I provided tribo values of −25.6 $\mu$C/g and −7.9 $\mu$C/g at, respectively, 20 and 80 percent relative humidity, or significantly lower charging levels than those of the toners of Examples I, II, and III.

EXAMPLE IV 260.0 Grams of the latex emulsion as prepared in Example I and 220.0 grams of an aqueous carbon black dispersion containing 6.7 grams of REGAL 330® carbon black and 2.6 grams of the cationic surfactant SAN IZOL B™ were simultaneously added to 400 milliliters of water with high shear stirring by means of a polytron. The mixture was transferred to a 2 liter reaction vessel and heated at a temperature of 50° C. for 1.5 hours before 35 milliliters of 16 percent aqueous NEOGEN R™ solution were added. Subsequently, the mixture was heated to 93° C. and held there for a period of 4 hours, before cooling down to room temperature, and filtered. The filter cake was redispersed in 4 liters of water with the aid of a mechanical stirrer, and the resulting toner slurry was brought to a pH of 8.5 with dilute aqueous KOH solution, stirred for 30 minutes, and filtered. The filter cake was redispersed in 4 liters of water again, stirred for 30 minutes, and filtered. The washing was repeated twice in the same manner.

85 Grams of the filter cake, which contained about 50 grams of dry toner particles, were dispersed in 500 milliliters of water. After the pH of the mixture was adjusted to 8.5 with dilute aqueous KOH solution, 0.13 gram of zinc sulfate heptahydrate was added. The resulting mixture was heated to 50° C. with stirring before a solution of 0.23 gram of 3,5-di-tert-butylsalicylic acid and 0.15 gram of 85 percent potassium hydroxide in 20 milliliters of water was added. The reaction mixture was then stirred at 50° C. for two hours, and filtered. The resulting toner, which was comprised of resin, pigment, and on the toner surface a charge enhancing entity derived from the reaction of zinc sulfate and 3,5-di-tert-butylsalicylic acid, showed a particle size of 7.1 microns in volume average diameter, and a particle size distribution of 1.19 as measured with a Coulter Counter. The tribo values of the toner as evaluated, according to the procedure of Example I, were −45.3 $\mu$C/g and −16.1 $\mu$C/g at, respectively, 20 and 80 percent relative humidity.

COMPARATIVE EXAMPLE B

A comparative black toner was prepared in accordance with the procedure of Example III except that the toner was not subjected to the reaction with zinc ion and 3,5-di-tert-butylsalicylic acid. The toner evidenced a particle size of 7.0 microns in volume average diameter and a GSD of 1.20.

Evaluation of the toner in accordance with the procedure of Example I provided tribo values of −10.3 μC/g and −4.2 μC/g at, respectively, 20 and 80 percent relative humidity, or significantly lower charging levels than that of the toner of Example IV.

EXAMPLE V 260.0 Grams of the latex emulsion as prepared in Example I and 220.0 grams of an aqueous yellow pigment dispersion containing 9.3 grams of Pigment Yellow 17 and 2.6 grams of cationic surfactant SANIZOL B™ were simultaneously added to 400 liters of water with high shear stirring by means of a polytron. The mixture was transferred to a 2 liter reaction vessel and heated at a temperature of 50° C. for 1.5 hours before 45 milliliters of 16 percent aqueous NEOGEN R™ solution were added. Subsequently, the resulting mixture was heated to 95° C. and held there for a period of 4 hours before cooling down to room temperature, and filtered. The filter cake was redispersed in 4 liters of water with the aid of a mechanical stirrer, and the resulting toner slurry was brought to a pH of 8.5 with dilute aqueous KOH solution, stirred for 30 minutes, and filtered. The filter cake was redispersed in 4 liters of water again, stirred for 30 minutes, and filtered. The washing was repeated twice in the same manner.

85 Grams of the filter cake, which contained 50 grams of dry toner particles, was dispersed in 500 milliliters of water. After the pH of the mixture was adjusted to 8.5 with dilute aqueous KOH solution, 0.13 gram of zinc sulfate heptahydrate was added. The resulting mixture was heated to 50° C. with stirring before a solution of 0.23 gram of 3,5-di-tert-butylsalicylic acid and 0.15 gram of 85 percent potassium hydroxide in 20 milliliters of water was added. The reaction mixture was then stirred at 50° C. for two hours and filtered. The resulting toner, which was comprised of resin, pigment, and on the toner surface a charge enhancing entity derived from the reaction of zinc sulfate and 3,5-di-tert-butylsalicylic acid, showed a particle size of 6.8 microns in volume average diameter and a particle size distribution of 1.18 as measured with a Coulter Counter. The tribo values of the toner as evaluated according to the procedure of Example I were 52.8 μC/g and −17.6 μC/g at, respectively, 20 and 80 percent relative humidity.

COMPARATIVE EXAMPLE C

A comparative yellow toner was prepared in accordance with the procedure of Example IV except that the toner was not subjected to the reaction with zinc sulfate and 3,5-di-tert-butylsalicylic acid. The toner showed a particle size of 6.7 microns in volume average diameter and a particle size distribution of 1.19. Evaluation of the toner in accordance with the procedure of Example I provided tribo values of −13.6 μC/g and −4.4 μC/g at, respectively, 20 and 80 percent relative humidity, or significantly lower charging levels than that of the toner of Example V.

EXAMPLE VI 260.0 Grams of the latex emulsion as prepared in Example I and 220.0 grams of an aqueous magenta pigment dispersion containing 5.5 grams of Pigment Red 81.3 and 2.6 grams of the cationic surfactant SANIZOL B™ were simultaneously added to 400 milliliters of water with high shear stirring by means of a polytron. The mixture was transferred to a 2 liter reaction vessel and heated at a temperature of 50° C. for 1.5 hours before 35 milliliters of a 16 percent aqueous NEOGEN R™ solution were added. Subsequently, the resulting mixture was heated to 95° C. and retained there for a period of 4 hours before cooling down to room temperature, and filtered. The filter cake was redispersed in 4 liters of water with the aid of a mechanical stirrer, and the resulting toner slurry was brought to a pH of 8.5 with dilute aqueous KOH solution, stirred for 30 minutes, and filtered. The filter cake was redispersed in 4 liters of water again, stirred for 30 minutes, and filtered. This washing was repeated twice in the same manner.

85 Grams of the filter cake, which contained 50 grams of dry toner particles, was dispersed in 500 milliliters of water. After the pH of the mixture was adjusted to 8.5 with dilute aqueous KOH solution, 0.13 gram of zinc sulfate heptahydrate was added. The resulting mixture was heated to 50° C. with stirring before a solution of 0.23 gram of 3,5-di-tert-butylsalicylic acid and 0.15 gram of 85 percent potassium hydroxide in 20 milliliters of water was added. The reaction mixture was then stirred at 50° C. for two hours and filtered. The resulting toner, which was comprised of resin, pigment, and on the toner surface a charge enhancing entity derived from the reaction of zinc sulfate and 3,5-di-tert-butylsalicylic acid, showed a particle size of 6.9 microns in volume average diameter and a particle size distribution of 1. 21 as measured with a Coulter Counter. The tribo values of the toner as evaluated according to the procedure of Example I were −42.4 μC/g and −13.7 μC/g at, respectively, 20 and 80 percent relative humidity.

COMPARATIVE EXAMPLE D

A comparative magenta toner was prepared in accordance with the procedure of Example VI except that the toner was not subjected to the reaction with zinc sulfate and 3,5-di-tert-butylsalicylic acid. The toner evidenced a particle size of 7.0 microns in volume average diameter and a particle size distribution of 1.21. Evaluation of the toner in accordance with the procedure of Example I provided tribo values of −8.2 μC/g and −4.5 μC/g at, respectively, 20 and 80 percent relative humidity, or lower charging levels than that of the toner of Example VI.

EXAMPLE VII

A cyan toner was prepared in accordance with the procedure of Example I except that the filter cake from the reaction mixture after coalescence was redispersed in 1 liter instead of 4 liters of water. The resulting toner suspension was brought to a pH of 8.5 with aqueous KOH solution, and treated with 0.26 gram of zinc sulfate heptahydrate, 0.44 gram of 3,5-di-tert-butylsalicylic acid and 0.30 gram of 85 percent potassium hydroxide without additional washing. The treated toner, which was comprised of resin, pigment, and on its surface a charge enhancing entity derived from zinc sulfate and 3,5-di-tert-butylsalicylic acid, evidenced a particle size of 7.0 microns in volume average diameter and a particle size distribution of 1.19 as measured on a Coulter Counter. The tribo values of the toner as evaluated according to the procedure of Example I were −41 μC/g and −14.4 μC/g at, respectively, 20 and 80 percent relative humidity.

COMPARATIVE EXAMPLE E

A comparative toner was prepared in accordance with the procedure of Example VII except that the toner was not subjected to the treatment with zinc sulfate and 3,5-di-tert-butylsalicylic acid. The toner evidenced a particle size of 6.9 microns in volume average diameter and a particle size distribution of 1.22. Evaluation of the toner in accordance with the procedure of Example I provided tribo values of −10.3 μC/g and −6.2 μC/g at, respectively, 20 and 80 percent relative humidity, or significantly lower charging levels than that of the toner of Example VII.

Other modifications of the present invention may occur to those of ordinary skill in the art subsequent to a review of the present application and these modifications, including equivalents thereof, are intended to be included within the scope of the present invention.

What is claimed is:

1. A process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a salicylic acid, a catechol, or mixtures thereof at a temperature of from about 25° C. to about 80° C.; and optionally isolating the toner product, washing, and drying.

2. A process in accordance with claim 1 wherein said blending of said aqueous colorant dispersion with said latex emulsion containing resin is from about 20° C. to about 30° C.; said pH is from about 8 to about 11; subsequent to coalescence said toner is separated by filtration; and isolating said toner product by filtration, followed by washing and drying, and wherein said filtration removes soluble surfactants.

3. A process for the preparation of toner with resin and colorant comprising (i) preparing, or providing an aqueous colorant dispersion, which dispersion is comprised of a colorant and an ionic surfactant;

(ii) blending said colorant dispersion with a latex emulsion comprised of resin particles, a nonionic surfactant, and an ionic surfactant of opposite charge polarity to that of the ionic surfactant in said colorant dispersion;

(iii) heating the resulting mixture below about the glass transition temperature (Tg) of the latex resin particles to form toner sized aggregates;

(iv) heating the resulting aggregate suspension of (iii) above about the Tg of the latex resin particles in the presence of an aggregate stabilizer;

(v) filtering and optional washing the toner product, and thereafter redispersing the toner in water at a pH of above or equal to about 7;

(vi) adding to the resulting mixture a metal halide or salt, and then a mixture of an alkaline base and a salicylic acid together with a catechol at a temperature ranging from about 25° C. to about 80° C.; and (vii) cooling, followed by isolating the toner product, optionally washing, and optionally drying.

4. A process in accordance with claim 2 wherein said toner is prepared by blending the colorant dispersion with a latex emulsion by a high shearing device, and wherein the colorant dispersion is a pigment dispersion and contains an ionic surfactant, the latex contains a nonionic surfactant and an ionic surfactant of opposite charge polarity to that of ionic surfactant in the pigment dispersion; heating the resulting mixture at a temperature of about 30° C. to about 60° C. to effect formation of aggregates having a particle size of from about 2 to about 10 microns in volume average diameter; heating said aggregate suspension in the presence of an aggregate stabilizer to prevent, or minimize the aggregates from growing in size, and which heating is at a temperature of from about 65° C. to about 100° C.; filtering the toner and redispersing it in water at a pH above 7, and adding a metal halide or salt, and then an aqueous mixture of an alkaline base, and a salicylic acid, a catechol, or mixtures thereof, and which adding is at a temperature ranging from about 25° C. to about 80° C.; and isolating the toner product by filtration, washing, and drying.

5. A process in accordance with claim 2 wherein the product toner size is from about 2 to about 10 microns in volume average diameter, and said toner possesses a particle size distribution of from about 1.12 to about 1.35.

6. A process in accordance with claim 3 wherein the surfactant in the pigment dispersion is a cationic surfactant, and the ionic surfactant present in the latex emulsion is an anionic surfactant, or wherein the surfactant in the pigment dispersion is an anionic surfactant, and the ionic surfactant present in the latex emulsion is a cationic surfactant.

7. A process in accordance with claim 4 wherein the ionic surfactant in the pigment dispersion is a cationic surfactant, and the ionic surfactant present in the latex emulsion is an anionic surfactant.

8. A process in accordance with claim 3 wherein the heating of the latex, colorant, and surfactants in the aggregation (iii) is accomplished at temperatures of from about 15° C. to about 1 ° C. below the Tg of the latex resin for a duration of from about 0.5 hour to about 5 hours; the heating of the aggregate suspension in the coalescence (iv) is conducted at about 20° C. to about 50° C. above the Tg of the latex resin for a duration of about 1 hour to about 5 hours; and the adding of the metal salts and salicylic acid and/or catechol is accomplished at from about 40° C. to about 60° C. for a duration of from about 0.5 hour to about 3 hours.

9. A process in accordance with claim 1 wherein the metal halide or salt is selected from a group consisting of zinc acetate, zinc halide, zinc hydroxide, zinc nitrate, zinc sulfate, zinc toluene sulfonate, zinc trifluoroacetate, cadmium acetate, cadmium halide, cadmium carbonate, and cadmium sulfate.

10. A process in accordance with claim 3 wherein the metal halide or salt is selected from a group consisting of zinc acetate, zinc halide, zinc hydroxide, zinc nitrate, zinc sulfate, zinc toluene sulfonate, zinc trifluoroacetate, cadmium acetate, cadmium halide, cadmium carbonate, and cadmium sulfate.

11. A process in accordance with claim 1 wherein the latex resin is prepared by emulsion polymerization of vinyl monomers selected from the group consisting of styrene and substituted styrenes, 1,3-dienes, substituted 1,3-dienes, acrylates, methacrylates, acrylonitrile, acrylic acid, and methacrylic acid.

12. A process in accordance with claim 1 wherein the latex resin is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadieneacrylonitrile-acrylic acid), poly(styrene-butyl acrylate-acrylic acid), poly(styrene-butyl acrylate-methacrylic acid), poly(styrene-butyl acrylateacrylonitrile), and poly(styrene-butyl acrylate-acrylonitrile-acrylic acid); and wherein said resin is optionally present in an amount ranging from 80 percent by weight to about 98 percent by weight of toner.

13. A process in accordance with claim 3 wherein the resin is selected from the group consisting of poly(styrene-butadiene-acrylic acid) poly(styrene-butadiene-methacrylic acid), poly(styrene-butyl methacrylateacrylic acid), poly (styrene-butyl acrylate-acrylic acid), poly(styrene-butyl acrylate-acrylonitrile), poly(styrene-butyl acrylate-acrylonitrile-acrylic acid), and poly(styrene-butadiene-acrylonitrile-acrylic acid).

14. A process in accordance with claim 3 wherein the resin size is from about 0.05 to about 1 micron in average volume diameter, and the colorant particle size is from about 0.01 to about 1 micron in volume average diameter.

15. A process in accordance with claim 3 wherein the latex resin is prepared by emulsion polymerization of vinyl monomers selected from the group consisting of styrene and substituted styrenes, 1,3-dienes, substituted 1,3-dienes, acrylates, methacrylates, acrylonitrile, acrylic acid, and methacrylic acid.

16. A process in accordance with claim 3 wherein the nonionic surfactant present in the latex emulsion is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate and sodium dodecylnaphthalene sulfate.

17. A process in accordance with claim 3 wherein the anionic surfactant is selected from the group consisting of sodium dodecyl sulfate, sodium dodecylbenzene sulfate and sodium dodecylnaphthalene sulfate; and wherein the cationic surfactant is a quaternary ammonium salt.

18. A process in accordance with claim 3 wherein the nonionic, ionic surfactants are each present in an amount of from about 0.01 to about 5 weight percent of the total reaction mixture.

19. A process in accordance with claim 1 wherein the colorant is a pigment of carbon black, magnetite, cyan, yellow, magenta pigments, or mixtures thereof.

20. A process in accordance with claim 1 wherein the salicylic acid, catechol, metal halide or salt are each utilized in an amount of 0.01 to 5 percent by weight of toner solids.

21. A process in accordance with claim 1 wherein there is added to the surface of the formed toner metal salts, metal salts of fatty acids, silicas, metal oxides, or mixtures thereof in an amount of from about 0.1 to about 10 weight percent.

22. A process in accordance with claim 2 wherein the salicylic acid and/or catechol, and metal halide or salt are each selected in an effective amount of 0.01 to 5 percent by weight of toner.

23. A process in accordance with claim 3 wherein the salicylic acid and/or catechol, and metal halide or salt are each selected in an effective amount of 0.01 to 5 percent by weight of toner.

24. A process comprising blending a colorant dispersion with a latex emulsion containing resin and heating the mixture at a temperature below about, or equal to about the glass transition temperature (Tg) of the latex resin; heating at a temperature above about, or about equal to the Tg of the latex resin; isolating the toner mixture, and redispersing said mixture in water at a pH of equal to or above about 7; contacting the resulting mixture with a metal salt, and then contacting said mixture with a mixture of a base and a salicylic acid, a catechol, or mixtures thereof.

25. A process in accordance with claim 24 wherein the colorant is a pigment or a dye.

26. A process in accordance with claim 24 wherein the colorant is carbon black, cyan, yellow, magenta, or mixtures thereof.

* * * * *